United States Patent [19]

Fomby

[11] 3,992,116

[45] Nov. 16, 1976

[54] APPLICATOR BRUSH AND METHOD OF MAKING SAME

[76] Inventor: Kenneth A. Fomby, 402 Lindsay St., Gainesville, Tex. 76240

[22] Filed: Apr. 23, 1975

[21] Appl. No.: 570,844

Related U.S. Application Data

[62] Division of Ser. No. 338,384, March 5, 1973, Pat. No. 3,895,877.

[52] U.S. Cl. ..... 401/129; 300/21

[51] Int. Cl.[2] ..... A46B 3/02

[58] Field of Search ..... 15/193, 257.05; 300/21; 401/121, 122, 126–130

[56] References Cited

UNITED STATES PATENTS

| | | | |
|---|---|---|---|
| 624,934 | 5/1899 | Higgins | 401/128 X |
| 1,021,709 | 3/1912 | Snow | 401/129 |
| 1,690,035 | 10/1928 | O'Neill et al. | 401/129 |
| 2,075,570 | 3/1937 | Carpenter | 300/21 |
| 2,310,186 | 2/1943 | Abrams | 300/21 X |
| 2,391,077 | 12/1945 | Sticht | 300/21 |
| 3,085,281 | 4/1963 | Massman | 401/128 X |
| 3,469,928 | 9/1969 | Widegren | 401/128 X |

FOREIGN PATENTS OR APPLICATIONS

| | | | |
|---|---|---|---|
| 1,174,544 | 11/1958 | France | 401/128 |
| 39,591 | 6/1965 | Germany | 401/129 |
| 1,006,392 | 4/1957 | Germany | 300/21 |
| 503,026 | 10/1955 | Italy | 300/21 |
| 471,782 | 9/1937 | United Kingdom | 401/129 |

*Primary Examiner*—Daniel Blum
*Attorney, Agent, or Firm*—Wayland D. Keith

[57] ABSTRACT

An applicator brush handle with a self contained attachment cap for sealing a container, with the cap closing the container in air tight relation, when not in use, and with the handle extending upward from the cap, which handle and cap are molded integrally to eliminate assembly. The brush projects into the container when not in use, and the cap or cover may be readily removed, as by unscrewing, or the like, when it is desirable to use the material within the container, such as glue, cement, paint or other liquid to be coated onto a surface. Provision is made for molding the cap or cover integrally with the handle and with the portion to which the brush bristles are attached. Further provision is made to mold a socket in the stem to receive the brush bristles.

2 Claims, 7 Drawing Figures

APPLICATOR BRUSH AND METHOD OF MAKING SAME

This application is a division of my application Ser. No 338,384, now U.S. Pat. No. 3,895,877, issued July 22, 1975.

BRIEF SUMMARY OF THE INVENTION

This invention relates to a self contained applicator brush, a closure cap for a receptacle and a handle to enable a substantial portion of the brush handle, the closure cap and the brush receiving stem to be molded in assembled relation, thereby to avoid hand assembly of the several parts of the device, thus creating greater efficiency in the manufacture, and the molding of several of the parts integrally insures the rigidity of the device and enables the parts to be maintained in substantially unitary relation.

OBJECTS OF THE INVENTION

An object of the invention is to provide a method of molding a brush handle, a plastic container cap or cover, a brush stem, with certain configurations on the brush holder so the brush bristles may be attached thereto.

Another object of the invention is to provide a plastic handle and a stem portion, to which brush bristles are attached, with a plastic screw cap or container cover molded integrally therewith to produce a unitary component.

Still a further object of the invention is to provide a unitary, elongated, hollow plastic brush handle with an enlarged screw cap sealing lid intermediate the length of the handle, with circumferentially spaced ribs on the upper end of the handle above the lid, the upper end of the handle being closed, with the other end of the handle having an enlarged socket formed therein to receive the upper postion of the bristle brush, the bristles of which brush are bonded together so when the bonded portion of the brush is seated in the enlarged socket, an anchor rivet may be passed therethrough to anchor the bristles within the socket, so as to be integral with the handle.

DETAILED DESCRIPTION OF THE INVENTION

Figure 1:
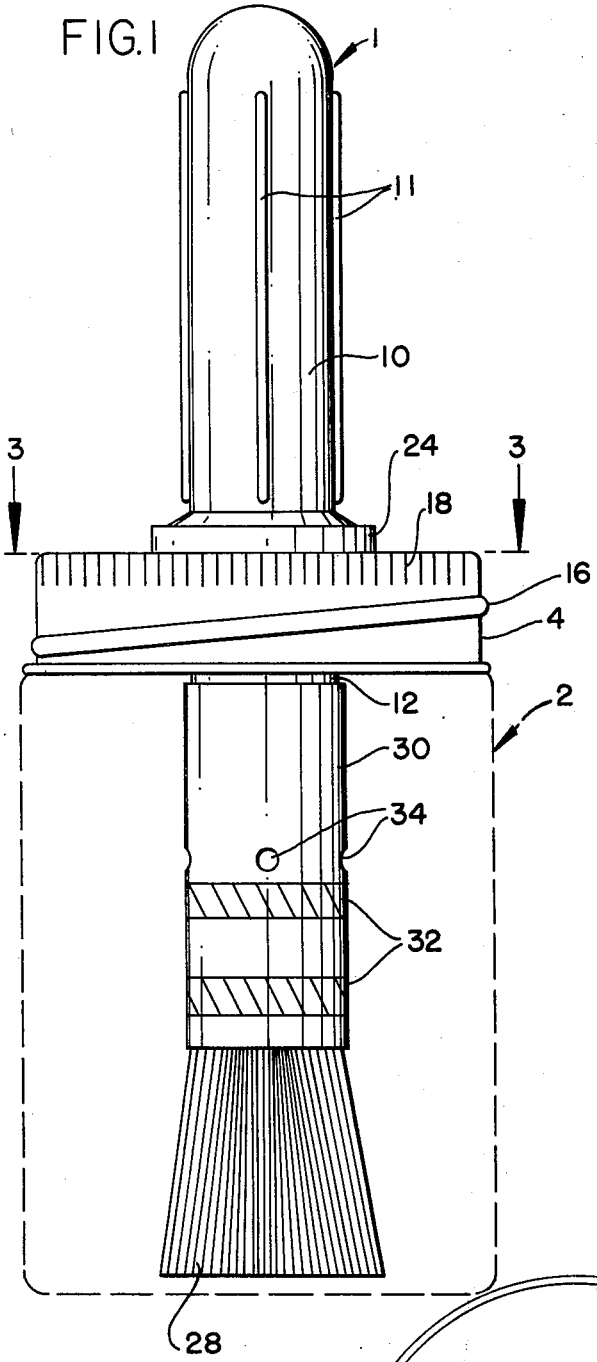
FIG. 1 is a side elevational view of a brush handle, a metallic screw cap and a brush stem with bristles attached thereto, with the metallic screw cap surrounding the plastic brush handle and stem element in unitary anchored relation, showing a container, in dashed outline, as associated therewith.
Figure 2:
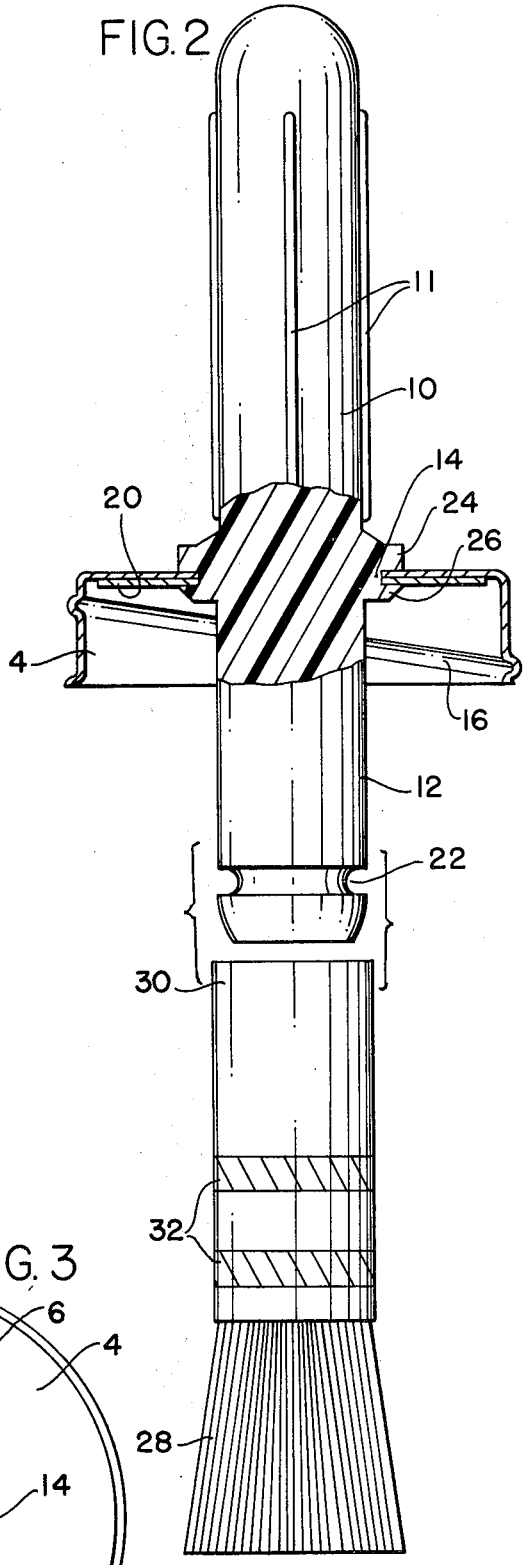
FIG. 2 is a fragmentary elevational view of a portion of the brush handle and brush stem, showing the metallic cap or cover anchored in fixed relation thereto, with parts being broken away and with parts being shown in section to bring out the details of construction.

With more detailed reference to the drawing in which like reference characters designated like parts in the several views thereof, the numeral 1 designates generally a composite brush, a metallic screw cap and a handle, for attachment to a container 2. The cap or cover 4, in the present instance, is shown to be screw threaded to be complementally received on the container 2. The contents of the container 2 may be glue, cement, paint or other liquid to be applied with a brush.

Figure 3:
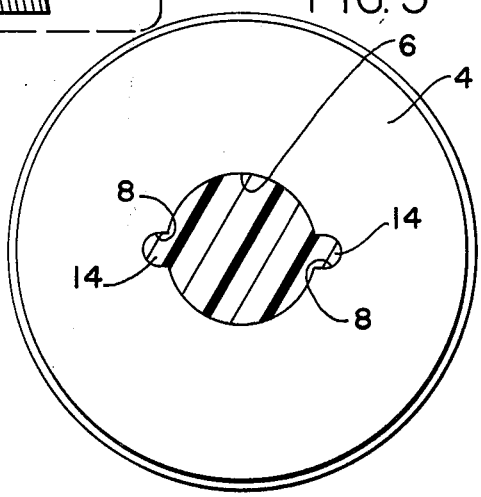
FIG. 3 is a sectional view taken on the line 3—3 of FIG 1, looking in the direction indicated by the arrows.
Figure 4:
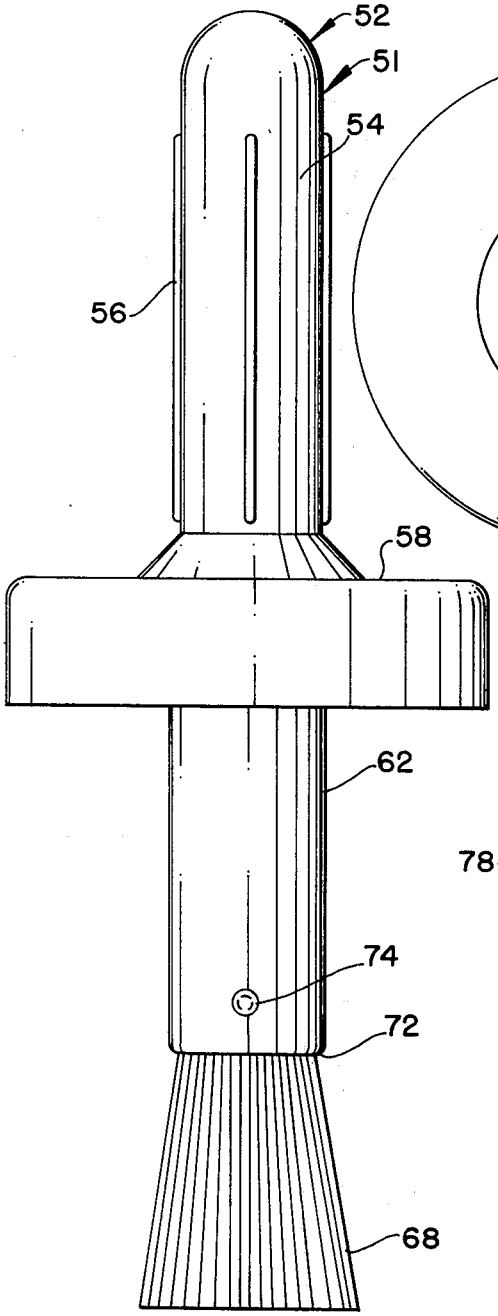
FIG. 4 is a side elevational view similar to FIG. 1, and of the preferred form of the invention.
Figure 5:
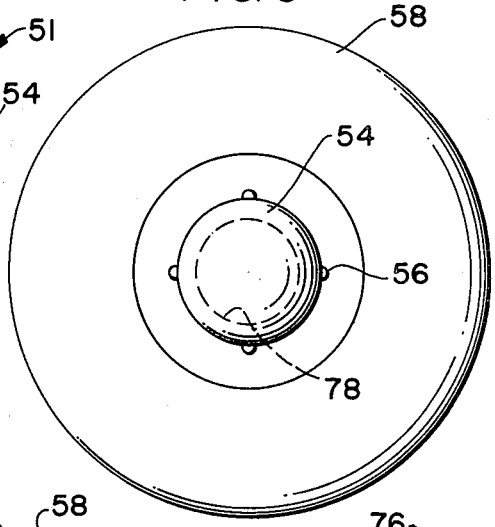
FIG. 5 is a top plan view of the preferred form of the invention.

The cap or cover 4 is centrally apertured, as indicated at 6, which aperture has one or more notches 8 formed therearound within the cover 4, which notches extend outward from the central aperture 6 to form an anchor with the plastic material being molded thereinto and therethrough to maintain the cover 4 against relative movement with respect to the handle 10 and the stem 12, as indicated at 14 and as will best be seen in FIG. 3. The handle 10 preferably has ridges 11 formed thereon to increase the friction when the handle is gripped for turning for the removal thereof, when the material contained in the container 2 is to be applied to a surface by means of the brush.

The metallic cap or cover 4 is shown to be screw threaded, as indicated at 16, however, other conventional fastening means may be employed and still be within the purview of the invention, and the fastening means is not to be considered as limited to threads. The metallic cover 4 preferably has serrations or a roughened portion 18 to allow the cap to be gripped and turned for ready removal thereof from the container, which cap includes the entire unit 1. The cap 4 has an apertured gasket 20 therein, which gasket may be of oiled paper, fiber or other suitable material that is compatible with the liquid within the container 2, with which it is to be used.

The cap 4 and gasket 20 are inserted into a mold cavity into which mold cavity plastic molding material is directed so that the mold cavity will be filled with liquified plastic, to mold the handle 10, and stem 12, with an annular groove 22 one end and with bosses 24 and 26 formed thereon intermediate the length of the handle 10 and stem 12, with the boss 24 being loacted on one side of the metallic cap or cover 4 and with the boss 26 being located on the opposite side of the metallic cap or cover 4, with the gasket 20 being intermediate the cap 4 and the boss 26, so as to firmly hold the metallic cover against longitudinal movement, after the plastic becomes hardened. The mold cavity is normally filled with thermo-plastic, which is injected in liquid form and which will harden upon cooling, however, any type of plastic which will harden in any manner is within the purview of the present invention.

Figure 6:
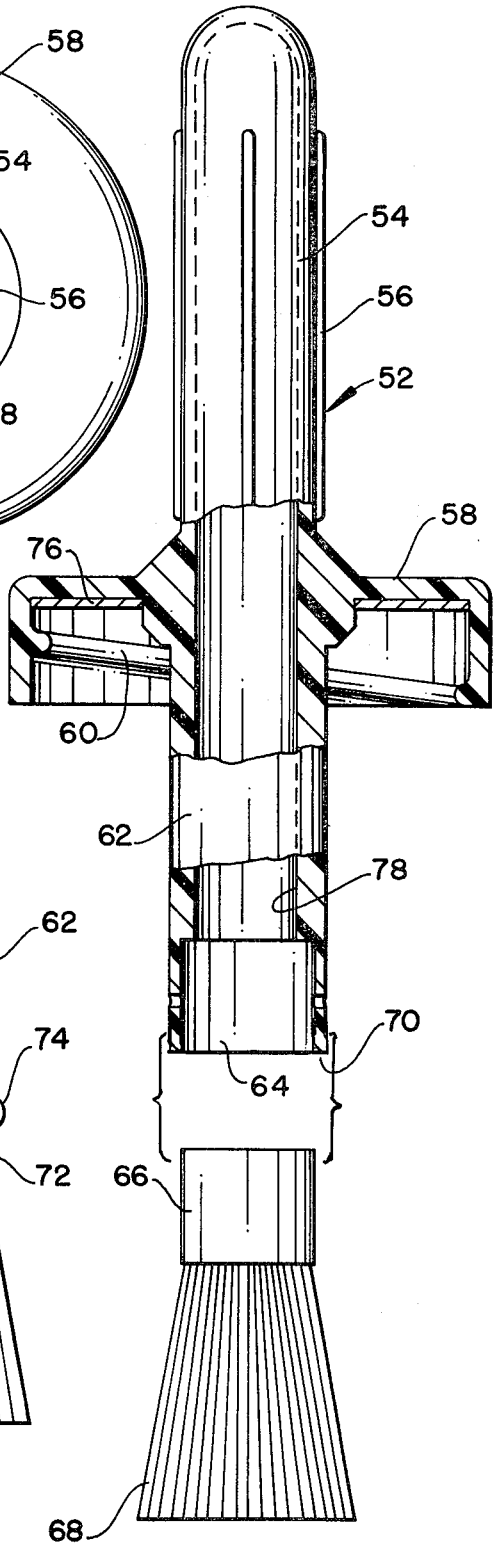
FIG. 6 is an exploded, elevational view of the invention, with parts being broken away and with parts being shown in section to show the details of construction.
Figure 7:
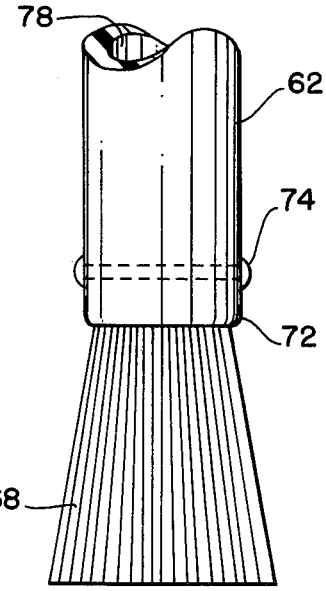
FIG. 7 is a fragmentary elevational view, with parts broken away and with parts shown in section, to show the attachment of the brush to the hollow brush stem.

With the metallic cover or cap 4 molded intermediate the length of the handle 10 and stem 12, a brush, which has bristles 28 inserted within a metallic ferrule 30. The upper portion of the bristles 28 are normally set within cement or a binder as shown at 66, FIG. 6, and crimp rolls or knurls 32 are applied to the ferrule to bindingly engage the ferrule 30 with the bristles 28, whereupon the hollow portion of the ferrule is moved upwardly onto the stem portion 12 to the desired position thereon and indentations 34 made in the metallic ferrule 30, which indentations are so formed as to register with the annular groove 22 in the stem 12 to anchor the brush against movement with respect to the ferrule 30. The ferrule 30 fixedly secures the brush in place on the unit, which unit is readily attachable to a container 2, as shown in FIG. 1.

While the present handle 10 and stem 12 have been shown to be round, as a matter of disclosure, it is to be understood that these portions may be made in any desired configuration, with the aperture within the cap or cover 4 being of complementary shape.

PREFERRED FORM OF THE INVENTION

A preferred form of the invention is shown in FIGS. 4 through 7. This form of the invention has a unitary, hollow, plastic handle with one end closed and the other end having an enlarged cylindrical socket formed therein, cover and hollow brush stem molded integrally, with a bristle brush mounted therein, which unit is designated generally by the numeral 51, and has the plastic handle, the cap or cover and the brush stem, having a socket therein, molded integrally and is designated generally by the numeral 52. The plastic unit 52 has a handle 54 on the upper end thereof, with ribs 56 spaced therearound to enable the handle to be readily gripped. A cap or cover 58 is molded integrally with the handle and is preferrably threaded, as indicated at 60, with a stem 62 extending downward therebelow. The lower end of the stem 62 has an enlarged socket 64 formed therein to receive a bonded portion 66 of brush head 68. The bristles of the brush head 68 are bonded together by cement, with the cementous bonded portion, as indicated at 66 being fully received in a complementary socket 64 of the stem 62 so when the lower edge 70 of the socket is crimped by a heated tool to curve under, as indicated at 72, the bonded portion 66 of the brush head is firmly secured to the stem 62. In order to further stabilize the brush head within the socket 64 a rivet 74 is passed through the cementous portion 66. A gasket 76, which may be of fiber, paper rubber, or other suitable material, is fitted within the upper portion of the cap 58 to seal against the top of the container, such as the container shown in FIG. 1.

The present brush arrangement serves the same purpose as the above described arrangement, however the present brush 51 is constructed of only two major parts, therefore requires less time to assemble and will stand rough usage without disintegrating. The handle 54 and stem 62 are hollow, as indicated at 78, above the socket 64, which gives a substantially uniform cross section for molding and requires less plastic material, and gives a handle and brush of lighter weight.

I claim:

1. A method of making an applicator brush for a container comprising the steps of:

a. providing a mold cavity having a portion to receive liquified plastic to unitarily form a hollow handle, with a closed end portion, and a hollow, open end stem portion, with an enlarged screw threaded cover intermediate the length of the handle and the stem portions, said handle, said stem and said cover having a common axis, b. further providing an enlarged hollow socket in the open end of the stem portion, c. providing a brush head with the bristles integrally bonded together near one end thereof, of a size and shape to be complementally received in the enlarged hollow socket, d. applying heat to the lower end of the socket to curve the plastic material inwardly to secure the brush head in the socket, and e. passing a fastener transversely through the stem, the enlarged socket and the bonded portion of the brush head to further secure the brush head within the socket.

2. An applicator brush for use with a container, which brush comprises;

a. a hollow handle, a hollow brush stem, with a screw threaded container cover intermediate the handle and the stem molded intergrally of plastic, 1. said screw threaded container cover being coaxial with the hollow handle and the hollow stem portion,
2. said handle having a closed end,
3. said stem portion having an enlarged open socket formed in the end thereof furthest from the handle, b. a brush head having the bristles thereof bonded together to form a portion to be complementally received within said enlarged open socket, 1. a fastener extending through the stem, the enlarged socket and through the bonded portion of the brush head to secure the brush against relative movement, c. the edge of the socket being curved inwardly to engage the brush head to further secure it in the socket.

* * * * *